US008471165B2

(12) United States Patent
Jokhovets et al.

(10) Patent No.: US 8,471,165 B2
(45) Date of Patent: Jun. 25, 2013

(54) DEVICE AND METHOD FOR RECOGNIZING CHARACTERISTIC FEATURES OF EMPTY CONTAINERS

(75) Inventors: Lioubov Jokhovets, Ilmenau (DE); Axel Fischer, Ilmenau (DE); Joern Foerster, Martinroda (DE); Stephan Springsguth, Langewiesen (DE)

(73) Assignee: Wincor Nixdorf International GmbH (DE)

( * ) Notice: Subject to any disclaimer, the term of this patent is extended or adjusted under 35 U.S.C. 154(b) by 251 days.

(21) Appl. No.: 13/012,405

(22) Filed: Jan. 24, 2011

(65) Prior Publication Data

US 2011/0180463 A1 Jul. 28, 2011

(30) Foreign Application Priority Data

Jan. 25, 2010 (EP) ..... 10401016

(51) Int. Cl.
*B07C 5/00* (2006.01)

(52) U.S. Cl.
USPC ..... 209/524; 209/523

(58) Field of Classification Search
USPC ..... 209/522–524; 194/208, 209
See application file for complete search history.

(56) References Cited

U.S. PATENT DOCUMENTS

| | | | | |
|---|---|---|---|---|
| 4,285,426 | A * | 8/1981 | Cahill | 194/209 |
| 5,154,276 | A * | 10/1992 | Lehtola | 198/457.07 |
| 5,248,102 | A | 9/1993 | Bohn | |
| 5,355,987 | A * | 10/1994 | DeWoolfson et al. | 194/209 |
| 5,423,492 | A * | 6/1995 | Willis | 241/81 |
| 6,547,055 | B2 * | 4/2003 | Coyne et al. | 194/207 |
| 6,817,462 | B1 * | 11/2004 | Salda | 194/208 |
| 7,997,417 | B2 * | 8/2011 | Saether | 209/522 |

FOREIGN PATENT DOCUMENTS

| | | |
|---|---|---|
| DE | 19519221 | 11/1996 |
| DE | 10117451 A1 | 10/2002 |
| DE | 10144518 C1 | 5/2003 |
| DE | 10340037 | 3/2005 |
| EP | 0924659 | 6/1999 |
| EP | 1 947 613 | 1/2006 |
| EP | 1947613 | 7/2008 |
| EP | 2083401 | 7/2009 |
| EP | 2105891 | 9/2009 |
| EP | 10 2009 026160 | 1/2011 |
| EP | 2278562 | 1/2011 |
| JP | 2002-087511 | 3/2002 |
| WO | 99-30292 | 6/1999 |
| WO | 2004-003830 | 1/2004 |
| WO | 2009083059 | 7/2009 |

* cited by examiner

*Primary Examiner* — Joseph C Rodriguez
(74) *Attorney, Agent, or Firm* — Harness, Dickey & Pierce, P.L.C.

(57) ABSTRACT

A device for recognizing characteristic features of an empty container having at least one flat support element on which the empty container can be placed with at least one lateral surface of said container on the contact surface of the support element, having a carrier to carry the empty container and having at least one optical sensor to optically scan the empty container, wherein the carrier is formed by the at least one support element, the at least one support element is carried rotatably about an essentially horizontal drive shaft, the empty container can be brought from an input position, in which the empty container is placed on the at least one support element, to a different location on the support arm and, after being scanned can be transferred to a downstream functional module.

17 Claims, 8 Drawing Sheets

DEVICE AND METHOD FOR RECOGNIZING CHARACTERISTIC FEATURES OF EMPTY CONTAINERS

CROSS REFERENCE TO RELATED APPLICATIONS

This application claims the benefit and priority of EP 10401016.0 filed Jan. 25, 2010. The entire disclosure of the above application is incorporated herein by reference.

BACKGROUND OF THE INVENTION

1. Technical Field

The invention relates to a device for recognizing characteristic features of an empty container having at least one planar support element on which the empty container can be placed on a contact surface of the support element with a lateral surface of said container, having a carrier to carry the empty container and having at least one optical sensor to detect at least one characteristic feature of an empty container and having a transport/sorting apparatus that removes and sorts the empty containers following detection of the at least one feature.

The invention further relates to a method for recognizing characteristic features of an empty container, wherein a lateral surface of the empty container is scanned by means of an optical sensor and wherein the empty container is guided during the scanning with a lateral surface on a supporting element while rotating about its longitudinal axis.

2. Discussion

Standard automated reverse vending machines have an input module to accept empty containers, for example bottles and/or beverage cans. The empty container inserted is transported to an identification module by a transport module. The empty container is rotated in the identification module with the aid of additional drives so that any identifying features applied to the empty container, e.g. barcode, deposit symbol and/or other special features, can be ascertained by means of an optical sensor. At least one sensor, for instance a barcode reader and/or a camera, is mounted on the device to determine the identifying features. Several sensors can be provided for determining different features. The empty container is taken to a sorting module from the identification module by a further transport module. In the sorting module, the empty container is taken to one of several possible conveyor elements that guide the empty to collecting stations, depending on the identifying features determined by the sensors. Optional provision can be made in addition for the empty containers to be fed to a compacting module to reduce volume. Devices of this type are also described as crushers.

An input module and a transport module for a reverse vending system are known from DE 101 44 518C1. The input module has a drop channel formed from two curved rods via which the empty container inserted through an input opening in an outer wall of the reverse vending machine is taken to the transport module located below the input opening. At the end of the drop channel facing the transport module, the input module has guide means that ensure that the empty container is placed in a standing position on the adjacent transport module. The transport module is configured in essence as a horizontally oriented endless conveyor belt.

An identification module for reverse vending machines is known from DE 10 2008 018 796 A1 in which empty containers conveyed in a standing position on a transport belt are scanned by an optical sensor. For this purpose, a stationary plate-shaped support element is provided above the transport belt that is aligned perpendicular to the section of the transport belt receiving the empty container and forms an acute angle to the direction of transportation. The standing empty containers being conveyed on the transport belt bear against the stationary plate as they are being transported. Because of the frictional force created between the plate and the empty container, the container is set rotating in the direction of transportation as it is being carried on the transport belt. The optical sensor is located and aligned in such a manner that it scans the empty container during its rotation at the plate and thus the complete circumference of the lateral surface of the empty container is detected. In this way it can be ensured that the barcode, the deposit symbol and/or any other characteristic feature of the empty container can be identified reliably regardless of its original position relative to the optical sensor.

A device for sorting empty containers that are taken to the device by way of a transport module is known from DE 101 17 451 A1. The sorting device has a drive shaft extending essentially parallel to the transport direction of the empty containers above an endless conveyor belt of the transport module. Sorting arms fixed against rotation are connected to the drive shaft that encompass spaced apart on both sides an empty container entering the effective area of the sorting device. By driving the drive shaft in one direction or the other, the sorting arms convey the empty container to one side or the other of the transport belt. The empty container can thus be directed to one of two specified conveyor elements. If more than two conveyor elements are to be implemented, several sorting devices can be arranged one after the other.

The disadvantage of the solutions known from the prior art is that the input, transport, identification and sorting functions are realized by means of separate functional modules. The functional modules represent separate structural units that are arranged one after the other and are linked to each other by means of information technology. As a result of this restriction, current reverse vending machines for empty containers are relatively large. Furthermore, because of the multiplicity of functional modules, they are expensive to manufacture and maintain and are relatively prone to breakdowns.

SUMMARY OF THE INVENTION

It is, therefore, the object of the present invention to provide an especially simple, compactly constructed and cost-effective device and a simplified method for returning empty containers.

To achieve this object, an embodiment of the invention is characterized in that the carrier is formed by the at least one support element and in that the at least one support element is carried to be rotatable about an essentially horizontal drive shaft in such manner that the empty container can be brought from an input position, in which the empty container can be placed on the at least one support element, into at least one transfer position from which the empty container can be passed on to a downstream functional module.

An advantage of the invention is that the support element supports the empty container and simultaneously acts as carrier for the empty container. A separate transport module to carry and transport the empty container is not necessary.

The input module, the identification module and the transport module connecting the input module and the identification module are preferably implemented as one functional and structural unit. As a result, the size of the reverse vending machine is reduced. Secondly, the entire device can be operated using a single drive so that substantial cost benefits result. In addition, the risk of malfunctions and breakdowns diminishes since the number of components is reduced, and the data link for separate functional modules for input, transport and identification of the empty container can be dispensed with.

In accordance with a preferred embodiment of the invention, the empty container is carried so that it can roll on the support element with its lateral surface and be scanned by the optical sensor as it rotates about its longitudinal axis. As an advantageous consequence, the lateral surface of the empty container can be detected around its entire circumference by the optical sensor. The characteristic features of the empty container, its geometry, the nature of its surface and its visual material properties can be read just like a barcode and/or a deposit symbol regardless of the orientation of the empty container when it is inserted. The rotation of the empty container about its longitudinal axis can take place without providing an additional drive simply on the basis of the rotational movement of the support element, against which the empty container is guided with its lateral surface so that it can roll, around the drive shaft.

If the characteristic feature is not recognized during a rotation of the support elements in one direction, the support elements can be rotated in the opposite direction.

In accordance with a further development of the invention, the longitudinal axis of the empty container in the input position and/or in the transfer position is oriented parallel to the drive shaft. As a result of the parallel positioning of the longitudinal axis and the drive shaft, the empty container rolls over its lateral surface as the support elements rotate about the drive shaft. This prevents the empty container from slipping or sliding along the support elements. The drive shaft of the support elements can be oriented in the direction of the user at an angle between 0 and 180 degrees. The preferred orientation of the drive shaft is dependent on the downstream sorting paths, the construction and the positioning of the motor.

In accordance with a further development of the invention, the support element carrying the empty container is located at an acute angle rotated downward in the input position and/or the transfer position. The acute angle is greater than 0° and less than 45°. Preferably the acute angle is greater than 0° and less than 15°. The empty container, in its input position and/or the transfer position, is advantageously brought into a defined stationary position as a result of the force of weight acting thereon. The stationary position can be brought about mechanically, for example, by a support element itself and by a fixed retaining element. Inserting the empty container is simplified to the extent that the customer does not have to position the empty container precisely. Instead, the empty container assumes its stationary position by itself. Transferring the empty container to a downstream functional module is also simplified since the position of the empty container is known exactly after it has been identified by the optical sensor. Since the empty container is brought into the input position and/or the transfer position solely due to the effect of weight, a separate drive is also not necessary so that the construction of the device can be further simplified and costs reduced.

In accordance with a further advantageous embodiment of the invention, the empty container in the input position and/or the transfer position can be brought into a defined stationary position as a result of the force of weight acting on it through a special geometry and alignment of the support element even without a fixed retaining element.

In accordance with a further advantageous embodiment of the invention, the support arms of the support element in the input position to receive an empty container are aligned symmetrically to a vertical plane running through the drive shaft. This embodiment possesses the same advantages as the embodiment previously described. The design, however, is considerably simplified by the symmetrical construction.

The support elements can have different geometries.

In accordance with a further development of the invention, the support element has a planar and/or curved and/or angled shape, at least in sections. A planar support element is advantageous if the empty container is to roll on the support element at a predetermined rotational speed and brought from the input position into the transfer position. A planar support element is additionally simple and cost-effective to produce.

A curved and/or angled support element provides the advantage that the empty container in the input position and/or in the transfer position and/or when bringing said container from the input position into the transfer position can be immobilized at specified locations on the support element. This geometry offers at least one possible stationary position in the input position and/or transfer position without requiring additional components.

An angled support element makes it possible to tip an empty container that is not round in cross-section, but rectangular for example, through the rotation of the support element about its longitudinal axis and to detect an initially concealed part of the surface not detectable by the optical sensor.

In accordance with a further development of the invention, the support element has at least two structurally identical support arms disposed offset around the drive shaft. The support arms project radially from the drive shaft. A support angle of 180° or less is included between adjacent support arms. For example, three structurally identical support arms can be preferably arranged offset to each other around the drive shaft at the same support angle. The three support arms can have the identical radial length. The support element is advantageously given the form of a rotor. For each rotation of the rotor, a number of empty containers corresponding to the number of support arms can be placed in the device, scanned in said device and moved into the transfer position. This increases the throughput of the device. In addition, the support arms form an angled support element with the advantages described.

The dimensions of the support elements are advantageously selected such that as the empty container rotates about its longitudinal axis its entire lateral surface can be scanned using at least one, preferably fixed, optical sensor.

In accordance with a further development of the invention, the empty container, after being optically scanned, can be taken to a specified functional module, for example for collection, compacting, further transportation, return or additional processing. Depending on the specified functional module, the support element is rotated about the drive shaft clockwise or counter-clockwise at an individually selectable speed of rotation. When determining the direction of rotation and the speed of rotation of the support element, the location of the functional module in particular and the size and weight of the empty containers must be taken into account. The sorting function is thereby advantageously integrated into the inventive device. As a result, provision of a separate sorting module can be dispensed with, as can a second transport module connecting the sorting module and the identification module. This measure benefits the compact size of the device. By dispensing with additional drives, guides or the like, the cost and the proneness of the device to break down are similarly reduced.

In accordance with a further development of the invention, the dimensions of the support arms of the support element are selected such that the empty container can be scanned around its entire circumference as the empty container rolls on the contact surface of the support element.

In accordance with a further development of the invention, two optical sensors located offset to each other are provided. As a result, the area of the surface of an empty container detected by the sensors is increased. The rolling of the empty container for detecting the lateral surface, in particular the characteristic features on the lateral surface, can thus take place in a smaller area. Empty containers lying or rolling on the support elements are optically scanned from different directions by the two sensors. In addition, the two sensors can be aligned with their optical axes in such a way that at least a first sensor detects the empty containers specifically in the input position and at least one second sensor detects the empty containers as they roll on the support elements and/or in the transfer position. The angle of rotation of the empty container for complete detection of the lateral surface is advantageously reduced compared with a previous solution by the size of the angle between the optical axes of the sensors. Since the angle of rotation is proportional to the distance covered by the empty container as it rolls, the radial length of the support arms, or the dimensions of the support element, are simultaneously reduced.

In accordance with a further development of the invention, the device is equipped with a reflector unit which reflects light in the direction of the at least one sensor. Without the reflector unit, this light would not reach the sensor. The reflector unit thus contributes to the sensor not only detecting light reflected directly from the surface of an empty container towards the sensor, but also light reflected outside an acceptance angle of the sensor centered around the optical axis of the sensor. Thus the sensor can detect, for example, not only the surface of an empty container facing it, but also the areas aligned laterally. The reflector unit makes it possible to use only a single sensor. The reflector unit is mounted in such a way in the detection zone or the measurement beam of the at least one optical sensor that the detection zone can be divided into partial detection zones or the measurement beam can be divided into partial measurement beams and such that the empty container can be scanned by at least two detection zones or measurement beams offset by a measurement angle with individual acceptance angles. Preferably the at least one optical sensor and the reflector unit can be positioned in such a way that the detection zone or the measurement beam and/or the partial detection zones or partial measurement beams from the sensor are disposed symmetrically with respect to a plane running vertically through the drive shaft. The reflector unit can have a first reflector located symmetrically with respect to this plane with two reflector segments located at an angle to each other that divide the detection zone emanating from the sensor or divide the measurement beam into two partial detection zones or partial measurement beams. The reflector unit can further have two second reflectors located spaced apart and symmetrical to the center plane and the drive shaft to reflect the two partial detection zones or partial measurement beams generated at the first reflector towards the support elements. As a result, an empty container can advantageously be located in two different detection zones or be scanned optically from two different directions using a single sensor. This reduces the angle of rotation of the empty container for complete detection of the lateral surface by the size of the angle between the two directions of observation or partial measurement beams. Since the angle of rotation is proportional to the distance covered by the empty container as it rolls, the radial length of the support elements, or the dimensions of the support elements, are simultaneously reduced as a result.

The dimensions of the support elements can be further reduced if there is no requirement for scanning the entire surface or if there is a requirement for the user to align the empty container, for example in the way that the empty container is to be placed with the barcode facing up in the direction of the sensor. It is also possible to reduce the dimensions of the support element if the empty container does not have a barcode but only recognition of the shape is undertaken. In this case, the empty container is not rotated at all on account of its rotational symmetry. The dimensions of the support element can consequently be reduced to the diameter of the empty container.

In accordance with a further development of the invention, a distance for the at least one optical sensor from the drive shaft is selected such that the measurement beam in the area of the drive shaft has a scanning field width perpendicular to the center plane that is at least twice as large as the radial length of the at least one support arm. The empty container can advantageously be detected by a single, preferably fixed, optical sensor as it rotates about its longitudinal axis. As long as the scanning field width of the optical sensor corresponds to twice the radial length of the support arm and the empty container is supported in the input position at an open end of a first support arm and in the transfer position at an open end of the second support arm, the support element has the necessary minimum diameter for complete detection of the empty container. The empty container is detected by the optical sensor in the input position and the transfer position.

In accordance with a further development of the invention, the position of the empty container, or the position of the support element, is continuously analyzed during the movement for identification or sorting. If all necessary features have been detected, the rotary motion, depending on the downstream sorting process, is continued for sorting, if necessary with a correction of rotational speed, or immediately discontinued. In this case, at least one change of direction is required for continued movement for sorting. This sequence considerably increases the throughput of the device.

In accordance with a further development of the invention, the support element can be rotated back and forth or tilted in order to detect the features of the empty container. This is particularly advantageous in a device in which the stationary position is ensured by the geometry of the support element in the input and/or transfer position. The scanning field of the sensor extends to both sides of the axis of the stationary position. If the features cannot be detected as the support element is rotated in one direction, the direction of rotation can be changed. This rolls the empty container into the other part of the scanning field relative to the axis of the stationary position and the previously concealed part of the surface is scanned.

The invention can be further characterized as a method where the empty container, as the result of a rotation of the support element about an essentially horizontal drive shaft, moves by itself from an input position in which the empty container is placed on the at least one support element into one or more transfer positions in which the empty container is delivered to a downstream functional module.

A particular advantage of the invention is that the rotation of the empty container around its longitudinal axis takes place automatically, that is without additional drives, solely on the basis of the force of weight acting on the empty container. As a result of rotation, a different partial area of the lateral surface of the empty container constantly moves into the detection zone of the optical sensor. As a result, partial areas of the surface of the empty container that were initially concealed in the input position and not detected by the optical sensor are optically detected as said container rolls from the input position into the transfer position. A barcode or a deposit symbol is consequently detected by the optical sensor during rotation along the support element regardless of the original orientation of the empty container in the input position. The detection process is considerably simplified by dispensing with separate drives.

BRIEF DESCRIPTION OF THE DRAWINGS

Embodiments of the invention are explained in greater detail using the Figures.

DESCRIPTION OF THE PREFERRED EMBODIMENTS

Figures 1A, 1B, 1C, 1D:
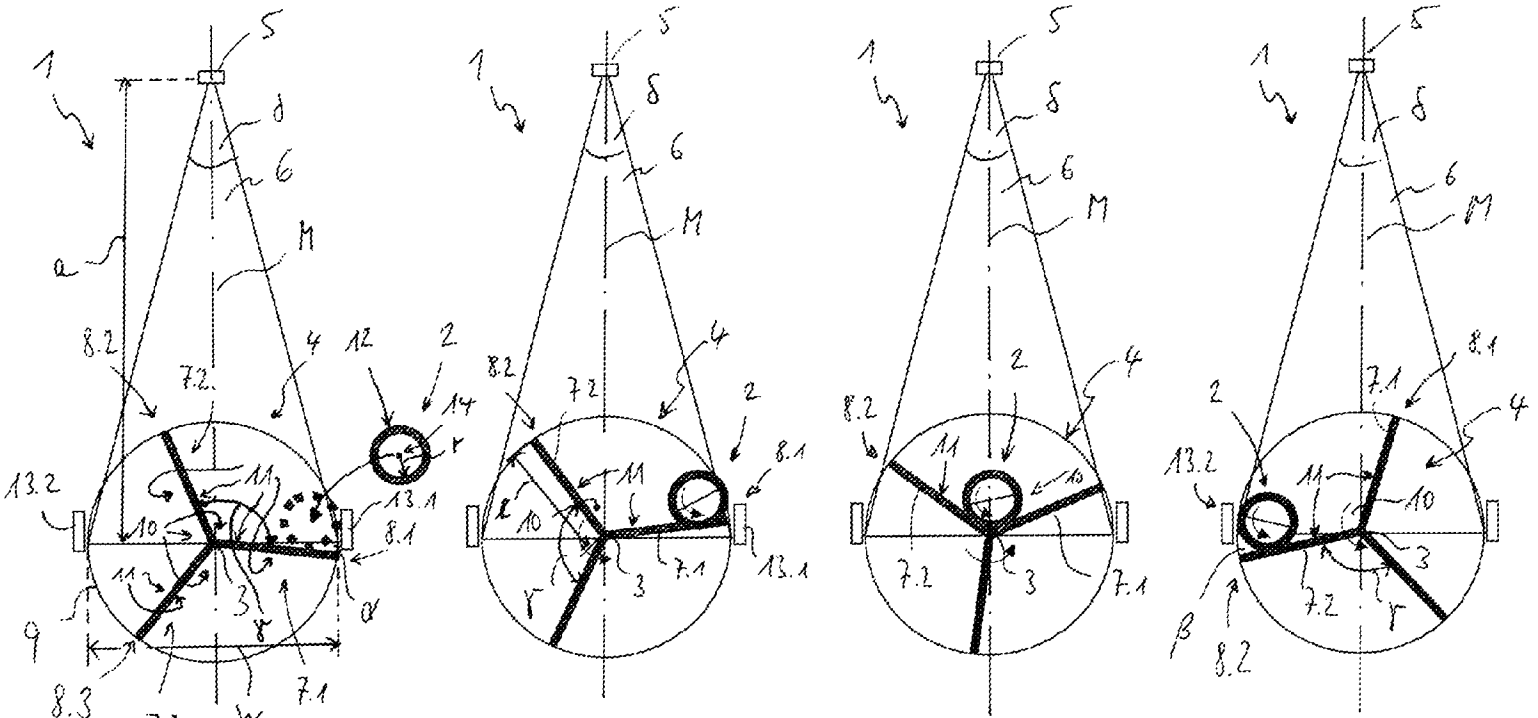
FIGS. 1*a*-1*d* show a schematic drawing of a device to recognize empty containers in a first embodiment.

A device 1 for recognizing characteristic features of an empty container 2 that is circular in cross-section in accordance with FIGS. 1*a* to 1*d* consists essentially of a support element 4 carried rotatably on a drive shaft 3 and an optical sensor 5 located at a radial distance from the drive shaft 3. A measurement beam 6 emanating from the optical sensor 5 serves to detect the empty container 2 lying against the support element 4 by means of a measurement beam 6 expanding from the optical sensor 5 towards the support element 4.

The device 1 is used, for example, in reverse vending machines that are set up by the retail trade to allow customers to automatically return empty containers 2 having a radius r. In reverse vending machines of this type, after the empty containers 2 are inserted by the customer, they first have to be taken to an identification unit. A determination is made in this identification unit whether it is a returnable empty container 2, for example a non-returnable or returnable bottle or can with a deposit, and the deposit to be paid to the customer upon the return of the empty container. After the empty container 2 has been detected in the identification module, the empty container 2 can be taken in a downstream sorting module to one of several transport elements and/or reduced in volume in a compacter, for example crushed or shredded. As a result of the automation process, the process of returning empties is particularly efficient and the sales staff is relieved of a significant burden.

The support element 4 is constructed in the shape of a rotor and possesses three essentially structurally identical support arms 7.1, 7.2, 7.3. The support arms 7.1, 7.2, 7.3 extend radially from the drive shaft 3 and have the same radial length l so that the open ends 8.1, 8.2, 8.3 of the support arms 7.1, 7.2, 7.3 lie on a common circular path 9 oriented coaxially to the drive shaft 3. The support arms 7.1, 7.2, 7.3 are disposed offset at an identical support angle $\gamma$ of 120°. A V-shaped trough 10 is formed between two adjacent support arms 7.1, 7.2, 7.3. The support arms 7.1, 7.2, 7.3 have in addition a planar contact surface 11 in the radial direction to guide the empty container 2. To this extent, the support element 4 forms planar contact surfaces 11 in the area of the support arms 7.1, 7.2, 7.3. The support element 4 is configured angled down in the area of the V-shaped troughs 10.

The optical sensor 5 is configured, as an example, as an image-transmitting sensor (camera) or as a laser scanner. The optical sensor 5, together with the essentially horizontally oriented drive shaft 3 of the support element 4, defines a center plane M of the device 1. The measurement beam 6 of the optical sensor 5 is configured symmetrically with respect to this center plane M. The measurement beam 6 of the optical sensor 5 spreads out starting from the optical sensor 5 in the direction of the support element 4. At the level of the drive shaft 3, the measurement beam 6 has a scanning field width w perpendicular to the center plane M that is twice as large as the radial length l of the support arms 7.1, 7.2, 7.3. As free design parameters for selecting the scanning field width w, firstly the distance a of the optical sensor 5 from the drive shaft, secondly an acceptance angle $\delta$ of the measurement beam 6 are available. It generally holds that with a smaller acceptance angle $\delta$, the distance a from sensor 5 to drive shaft 3 has to be increased. With an increasing acceptance angle $\delta$, the distance a can be reduced. Typical acceptance angles $\delta$ of commercial optical sensors lie in the range between 0° and 120°, for example 30° or 60°.

The method for ascertaining the characteristic features of the empty container 2 is as follows: The empty container 2 is placed in a basic position of the device 1 in accordance with FIG. 1 with an lateral surface 12 of said container on the contact surface 11 of a first support arm 7.1, 7.2, 7.3 of the support element 4 facing the optical sensor 5. The support element 4 is positioned so that the first support arm 7.1 is located rotated down at an acute angle $\alpha$ from the horizontal. Acute angle $\alpha$ is greater than 0° and smaller than 45°. Preferably acute angle $\alpha$ is greater than 0° and smaller than 15°. The empty container 2 can be placed manually by a customer at any position on first support arm 7.1 through a recess in a housing of the device 1, which is not shown. Because of the force of weight (gravity) acting on the empty container 2, the empty container 2 is moved automatically in the direction of the open end 8.1 of the first support arm 7.1 until the empty container 2 is stopped stationary in an input position (first stationary position) against a first fixed retaining element 13.1 of the reverse vending machine. The lateral surface 12 of the empty container 2 is lying on the contact surface 11 of the first support arm 7.1 facing the optical sensor 5 and against the first fixed retaining element 13.1. A longitudinal axis 14 of the empty container 2 is arranged oriented parallel to the drive shaft 3.

After the empty container 2 has been inserted, the support element 4 is rotated counter-clockwise around the drive shaft 3 by a drive (not shown). As soon as the first support arm 7.1—as shown in FIG. 1*a*—passes the horizontal, the empty container 2 moves automatically and while rotating about its longitudinal axis 14 from the open end 8.1 of the first support element 7.1 in the direction of the drive shaft 3. In accordance with FIG. 1*c*, the empty container 2 reaches the V-shaped trough 10 between the first support arm 7.1 and a second support arm 7.2 at a time when both the first support arm 7.1 and the second support arm 7.2 are positioned above the drive shaft 3. Support element 4 is rotated further in a counter-clockwise direction until the second support arm 7.2 in accordance with FIG. 1*d* is positioned below the drive shaft 3 and includes an acute angle $\beta$ with the horizontal. The acute angle β is greater than 0° and smaller than 45°, preferably greater than 0° and smaller than 15°. Acute angle α and acute angle β can be chosen to be equal.

As soon as second support arm 7.2 passes the horizontal, the empty container 2 moves out of the V-shaped trough 10 in the direction of the open end 8.2 of second support arm 7.2. As it does so, it rotates about its longitudinal axis 14 and reaches a transfer position (second stationary position) as soon as it is lying with its lateral surface 12 against the second, similarly fixed retaining element 13.2. To bring the empty container 2 from the input position into the transfer position, support element 4 is required to rotate through less than 90°. From the transfer position, the empty container 2 can be taken to a downstream functional module (not shown), for example, a transport module having at least one conveyor element 27 or a compacter or at least one collection bin 23, 24,25, 26. (see, FIGS. 5-7)

The rotational speed of the empty container 2 about its longitudinal axis 14 matches the angular velocity of support element 4 rotating about drive shaft 3 for as long as the empty container 2 is immobile against the open ends 8.1, 8.2 of support arms 7.1, 7.2 or in the V-shaped trough 10 and there is no relative motion with respect to support element 4. As soon as the empty container 2 rolls on the support arms 7.1, 7.2 of support element 4, the rotation of the empty container 2 about its longitudinal axis 14 is added to the rotary motion of support element 4 about the drive shaft 3. Consequently, the rotational speed of the empty container 2 is greater than the angular velocity of support element 4.

The support element 4 has a dual function when an empty container 2 is detected. First, it acts as a support surface on which the empty container 2 lies while rotating about its longitudinal axis 14. In addition, the support element 4 carries the empty container 2 so that a separate carrier, for example a transport belt is not required.

If the scanning field width w of the measurement beam 6 corresponds to at least twice the length l of the support arms 7.1, 7.2, 7.3, the empty container 2 is detected by the optical sensor 5 regardless of its position on support element 4. The radial length l of the support arms 7.1, 7.2, 7.3 can be selected such that the surface 12 of the empty container 2 is detected by the optical sensor 5 around its full circumference. The minimum required radial length of the support arm 7.1, 7.2, 7.3 is defined by the ratio of the product of Pi (π) to the maximum radius r of the largest empty container 2 accepted and to the angular rotation required to detect the complete circumference of the lateral surface 12 of the empty container 2 on the one hand, and to 360° on the other. This ensures that the characteristic features of the empty container 2, for instance, its external shape, its surface quality and/or its visual material properties as well as a barcode or deposit symbol applied to the surface of the empty container 2 can be detected using the optical sensor 5 regardless of the orientation of the empty container when inserted by the customer.

Figure 2B:
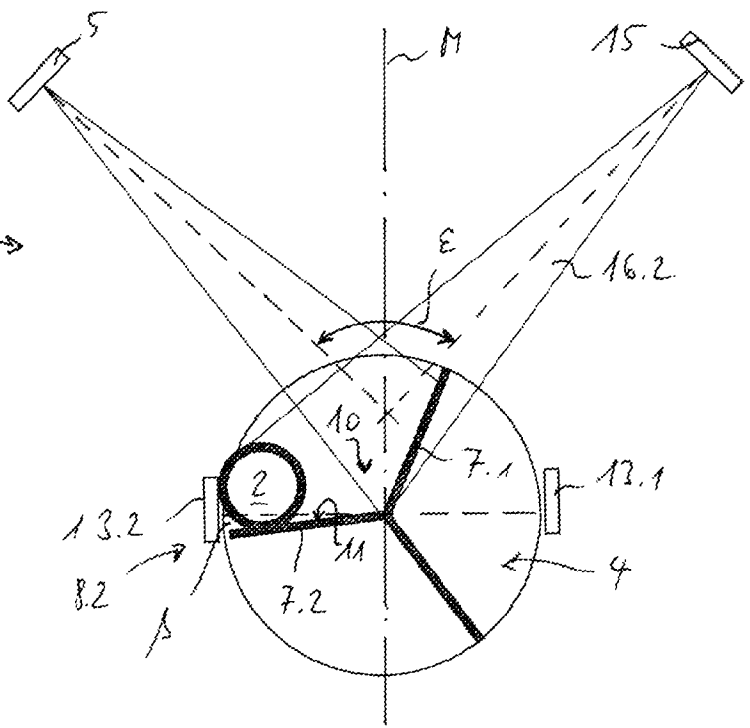
FIGS. 2*a*-2*b* show a second embodiment of the invention.
Figure 2A:
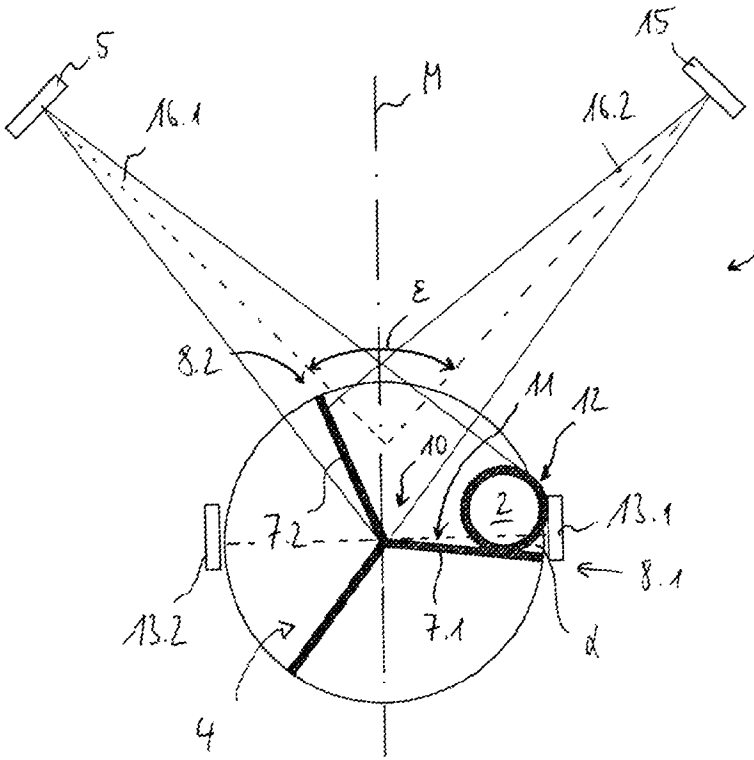

In accordance with an alternative embodiment of the device 1 as shown in FIGS. 2*a* and 2*b*, the empty container 2 being carried on the support element 4 can be scanned by two optical sensors 5, 15. The optical sensors 5, 15 are located symmetrically with regard to the center plane M on both sides of said plane. The optical sensors 5, 15 and the partial measurement beams 16.1, 16.2 emanating from the sensors 5, 15 are located offset by a measurement angle ϵ. The measurement angle ϵ is greater than 0° and smaller than 180°, preferably greater than 20° and smaller than 150°, and in a particularly preferred embodiment greater than 60° and smaller than 120°.

Identical components and component functions are given identical reference numerals.

In a known way, the empty container 2 is brought along first support arm 7.1 and second support arm 7.2 from the input position to the transfer position as said container rotates about its longitudinal axis. The lateral surface 12 of the empty container 2 is detected in the area of the open end 8.1 of first support arm 7.1 by partial measurement beam 16.1 of first optical sensor 5 and in the area of the open end 8.2 of second support arm 7.2 by partial measurement beam 16.2 of second optical sensor 15. In the area of the V-shaped trough 10 between first support arm 7.1 and second support arm 7.2 the surface 12 of the empty container 2 is detected by the two partial measurement beams 16.1, 16.2 of optical sensors 5, 15.

By providing two optical sensors 5, 15, the empty container 2 can be scanned particularly advantageously and in a simple manner by the two partial measurement beams 16.1, 16.2. In comparison to the single-sensor solution, a greater part of the surface 12 can be registered because of the measurement angle c between the sensors 5, 15 without any rotation. As a result, the angle of rotation of the empty container 2 needed for complete detection of the lateral surface 12 is reduced by the measurement angle c between the two partial measurement beams 16.1, 16.2. Since the angle of rotation is proportional to the distance covered by the empty container 2 rolling on support element 4, the radial length l of support arms 7.1, 7.2, 7.3, or the dimensions of support element 4, are reduced at the same time.

Figure 3A:
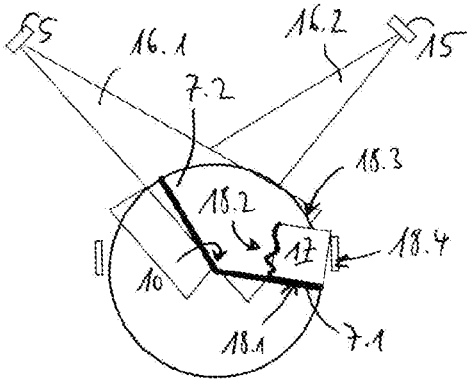
FIGS. 3*a*-3*e* show a schematic drawing for the detection of empty containers that are rectangular in cross-section by means of the device in accordance with FIGS. 2*a* and 2*b*.
Figure 3B:
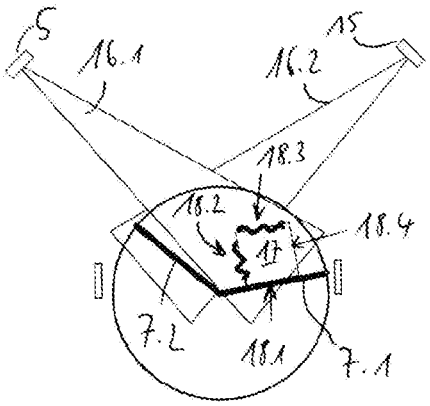
Figure 3C:
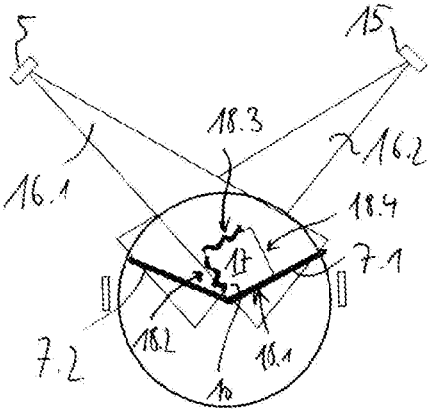

The dual-sensor embodiment of FIGS. 2*a* and 2*b* offers a further advantage in the detection of non-rolling empty containers 17, which are quadratic in cross-section, for example. In accordance with FIGS. 3*a* to 3*e*, in which only the support arms 7.1 and 7.2 necessary for operation are illustrated, the empty container 17, which is square in cross-section, slides from the input position in the direction of the V-shaped trough 10 between first support arm 7.1 and second support arm 7.2 placing a first lateral face 18 against the contact surface 11 of the first support arm 7.1. In the input position from FIG. 3*a*, a second lateral face 18.2 of the empty container 17 can be scanned by first sensor 5 alone. With increasing rotation of the support element in the counter-clockwise direction in accordance with FIG. 3*b*, a third lateral face 18.3 of the empty container 17 is rotated into partial measurement beam 16.1 of first sensor 5 such that a third lateral face of the empty container 17 can be scanned by first sensor 5.

Figure 3D:
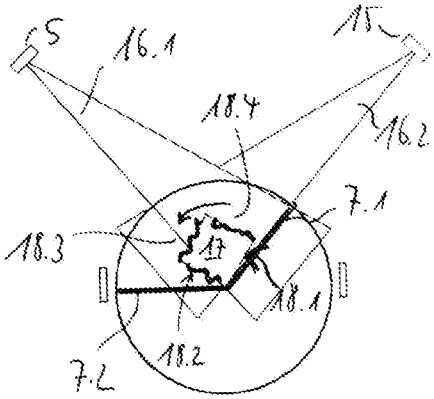
Figure 3E:
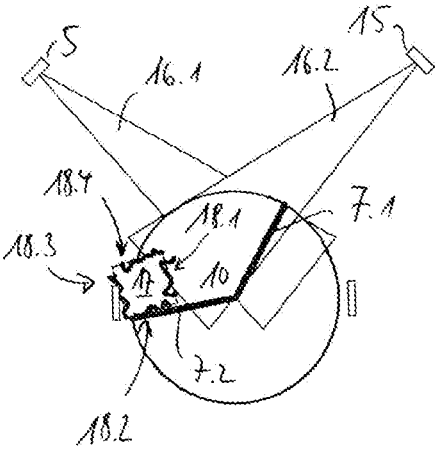

With continuing rotation of support element 4, the empty container 17 reaches the V-shaped trough 10 (FIG. 3*c*) and tilts in the direction of second support arm 7.2 as a result of the force of weight acting upon it as soon a center of gravity of the empty container 17 passes the center plane M (FIG. 3*d*). As a result of the empty container 17 sliding in the direction of the V-shaped trough 10 and said container tilting in the direction of second support arm 7.2, a fourth lateral face 18.4 of the empty container 17 comes into the effective range of partial measurement beam 16.2 of second sensor 15.

As soon as second support arm 7.2 has rotated beyond the horizontal and is below the drive shaft 3, the empty container 17, placing its second lateral face 18.2 against the contact surface 11 of the second support arm 7.2, slides from the V-shaped trough 10 towards the open end 8.2 of second support arm 7.2. At the latest when reaching the transfer position according to FIG. 3*e*, first lateral face 18.1, which initially lay against contact surface 11 of first support arm 7.1 and could not be detected optically, comes into the detection zone of second partial measurement beam 18.2 of second optical sensor 15.

Figure 4:
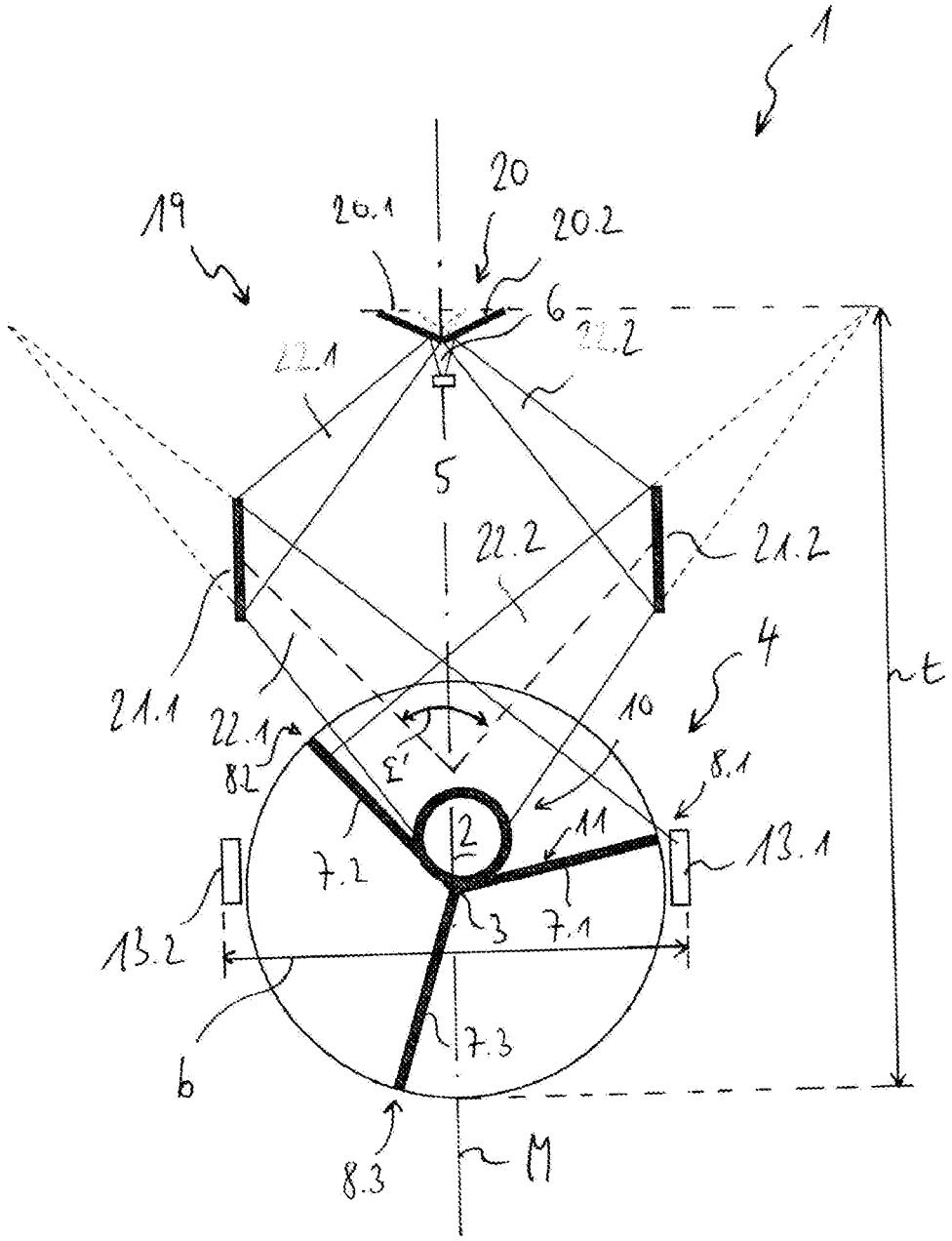
FIG. 4 shows a third embodiment of the device.

An alternative embodiment of the invention as shown in FIG. 4 provides for a reflector unit 19 to be mounted in the partial measurement beam 6 of optical sensor 5. The reflector unit 19 consists of a first reflector 20 and two second reflectors 21.1, 21.2. First reflector 20 is located like sensor 5 in the center plane M and is made up of two reflector segments 20.1, 20.2 arranged angled towards one another. The angled reflector segments 20.1, 20.2 of first reflector 20 serve to divide the measurement beam 6 emanating from optical sensor 5 into two partial measurement beams 22.1, 22.2 which, like the original measurement beam 6, spread out symmetrically with respect to center plane M. The two partial measurement beams 22.1, 22.2 strike the second reflectors 21.1, 21.2 and are reflected from there towards support element 4. The partial measurement beams 22.1, 22.2 include the measurement angle ϵ'. Second reflectors 21.1, 21.2 are located in such a way between the sensor and the support element and laterally spaced apart from the center plane M that at least first partial measurement beam 22.1 scans the empty container 2 in the input position and at least second partial measurement beam 22.2 scans the empty container 2 in the transfer position.

With respect to the advantages and the reduction of the dimension of support element 4, the reflector solution in accordance with FIG. 4 corresponds to the dual-sensor solution in accordance with FIGS. 2*a* and 2*b*. Since, however, only one sensor 5 is provided that is located in the center plane M, the dimensions of the device 1 can be further reduced compared with the dual-sensor solution. For example, it has been possible to reduce a width b to less than 300 mm and a height t to less than 600 mm by using the reflector solution.

Compared with the embodiment of the invention of FIG. 1, the radial length of support arms 7.1, 7.2, 7.3 in the dual-sensor solution from FIGS. 2*a* and 2*b* and the reflector solution from FIG. 4 can be reduced by the ratio of the product of Pi to the measurement angle ϵ, ϵ' and the radial length l on the one hand, and 360° on the other. For example, the length l of support arms 7.1, 7.2, 7.3 at the measurement angle ϵ, ϵ' of 120° is reduced by one third and at the measurement angle ϵ, ϵ' of 60° by one sixth.

Figure 5:
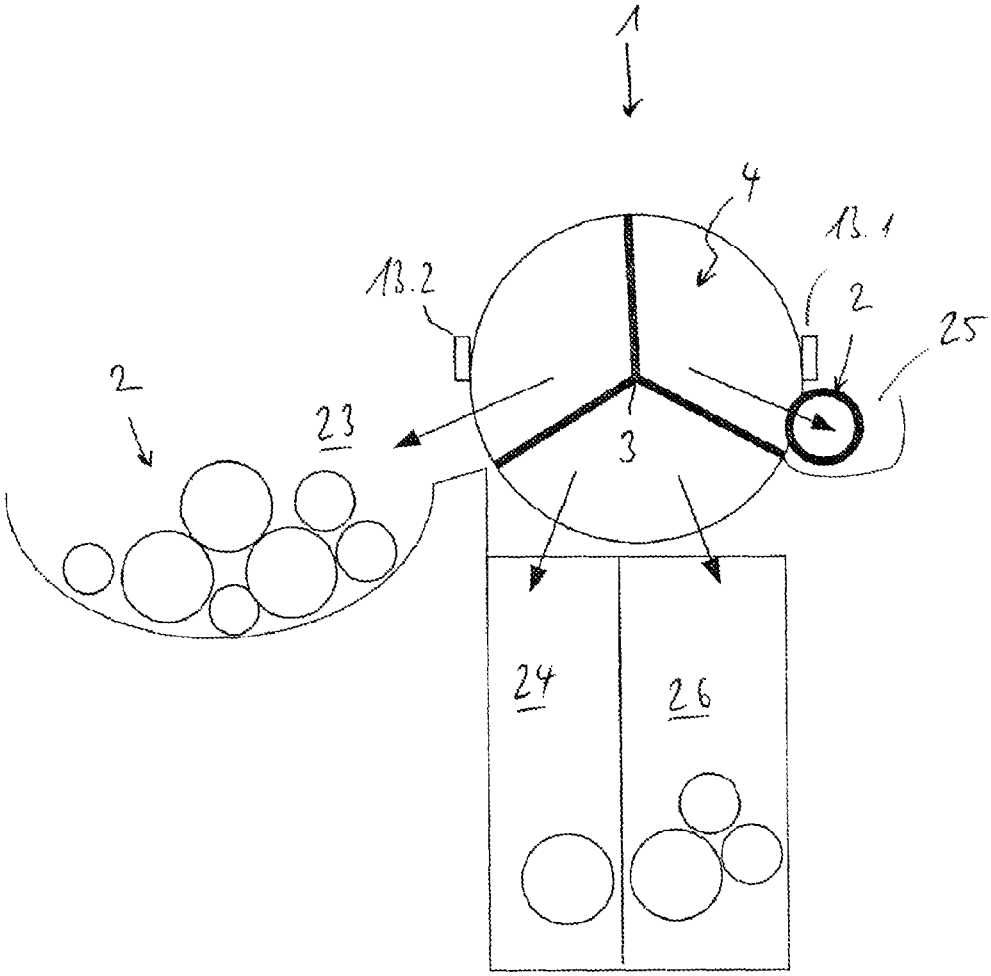
FIG. 5 shows a schematic drawing of the device with sorting function in a first embodiment.

In accordance with a further embodiment of the invention as shown in FIG. 5, the device 1 can implement a sorting function. Depending on the direction of rotation and the rotational speed of support element 4, the empty container 2 is taken from the transfer position to the specified collection bin 23, there is a total number of four collection bins 23, 24, 25, 26. If support element 4 is rotated slowly from the transfer position in a counter-clockwise direction around the drive shaft 3, the empty container 2 goes to the first collection bin 23. With a fast rotational movement of support element 4 in a counter-clockwise direction, second support arm 7.2 acting as a carrier for the empty container 2 is rotated away under the empty container 2 so that the empty container 2 is no longer carried by support element 4 and falls into the second collection bin 24 as a result of the force of weight acting on said container. As long as support element 4 is rotated in a clockwise direction and second support arm 7.2 passes the horizontal, the empty container 2 rolls from the open end 8.2 of second support arm 7.2 towards the V-shaped trough 10 and is finally stopped there. If support element 4 is rotated further slowly in a clockwise direction, the empty container 2 goes to the third collection bin 25, which can be configured, for example, as a return tray for non-returnable empty containers 2 and can be located facing the customer. If support element 4 is rotated quickly in a clockwise direction instead after reaching the V-shaped trough 10, the empty container 2 goes into the fourth collection bin 26.

Figure 6:
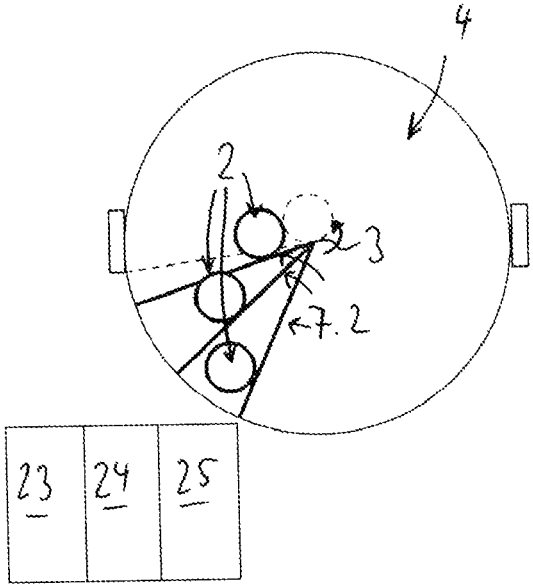
FIG. 6 shows a schematic drawing of the device with sorting function in a second embodiment.

FIG. 6 shows a further possibility of implementing the sorting function. After reaching the transfer position, support element 4, of which only support arm 7.2 relevant to operation is drawn in here, is initially rotated in a clockwise direction. The empty container rolls from the open end 8.2 of support arm 7.2 towards the V-shaped trough 10 and is retained here. Then support element 4 is rotated counter-clockwise such that the empty container 2, depending on the rotational speed of support element 4 and the final angular position of said element, is taken to a pre-determined collection bin, one of the three bins 23, 24, 25 located on a common side of center plane M. As an option, the weight and size of the empty container 2 can be determined and used to set the rotational speed.

Figure 7:
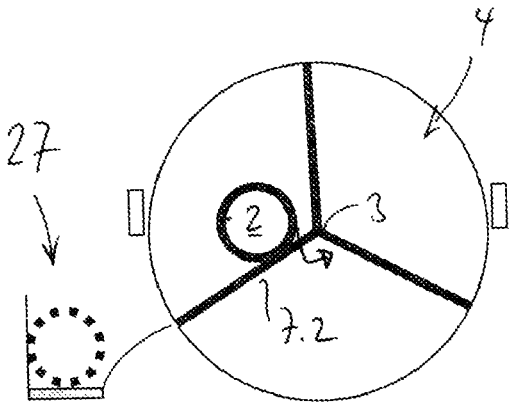
FIG. 7 shows a schematic drawing of the device with sorting function in a third embodiment.

Instead of providing collection bins 23, 24, 25, 26, the scanned empty container 2 can be taken to a conveyor element 27 represented by a conveyor belt, a conveyor slide or similar, in accordance with FIG. 7. As an alternative, of course, a different number of conveyor elements 27 and/or collection bins 23, 24, 25, 26 can be provided. Similarly, collection bins 23, 24, 25, 26 and conveyor elements 27 can be combined in a common array.

Figure 8:
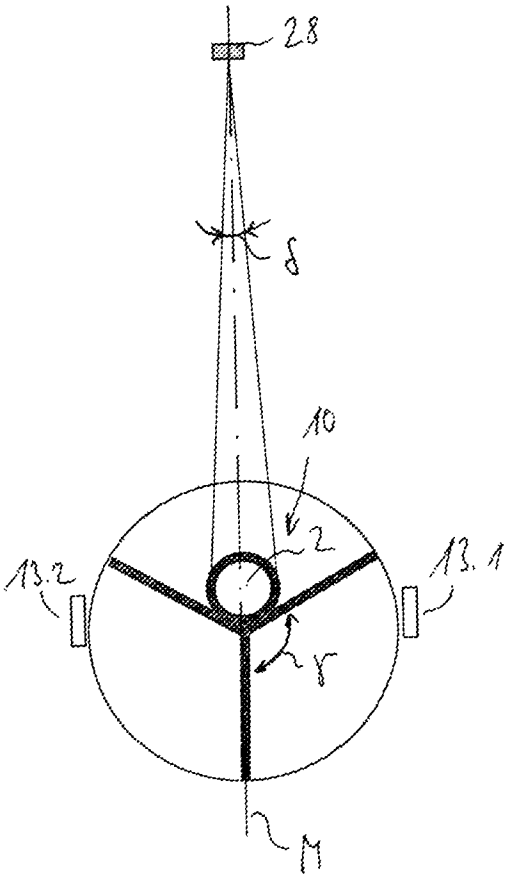
FIG. 8 shows a fourth embodiment of the device.

In accordance with an alternative embodiment of the invention shown in FIG. 8, the input position can be assumed in the V-shaped trough 10 instead of at an open edge 8.1 of first support arm 7.1. The empty container 2 is positioned in the device 1 by the customer in such a way that its barcode and/or deposit symbol is turned towards optical sensor 28. Optical sensor 28 is designed so that it detects the part of the lateral surface 12 of the empty container 2 with a small scanning field. After the empty container 2 has been scanned, support element 4 is rotated counter-clockwise in a known way. The empty container 2 detaches itself from the V-shaped trough 10 as soon as second support arm 7.2 has passed the horizontal and is located below the drive shaft 3. The container moves while rotating about its longitudinal axis towards the open end 8.2 of second support arm 7.2 and reaches the transfer position in a known way. In this alternative embodiment, a particularly cost-effective optical sensor 28 with a limited scanning field width w can be used advantageously. Because of the high integration density and the small number of components, particularly the drives, the already cost-effective device 1 can be further reduced in terms of cost by the low-priced sensor 28. Since no rotation of the bottle is required, the support elements and thus all the equipment can be dimensionally smaller.

Figure 9:
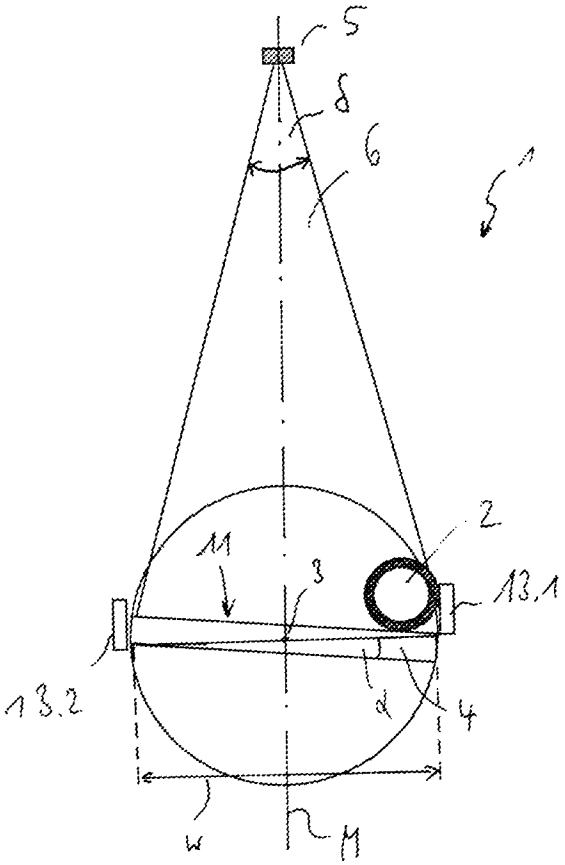
FIG. 9 shows a fifth embodiment of the device.

In accordance with a further alternative embodiment of the invention as shown in FIG. 9, support element 4 is configured completely planar. In contrast to the previous embodiments of FIGS. 1 to 8, no V-shaped trough is formed. As support element 4 rotates counter-clockwise, the empty container 2 moves continuously from the input position into the transfer position. Consequently, the empty container 2 arrives advantageously in the transfer position with a rotation of a few degrees counter-clockwise of support element 4. In addition, support element 4 is particularly simply shaped and thus cost-effective to produce.

The planar support element 4 can, of course, be combined with the dual-sensor solution of FIGS. 2 and 3 and with the reflector solution of FIG. 4.

In accordance with an alternative embodiment of the invention (not shown), the contact surface 11 of support element 4 can have any contour, in particular have a concave or convex curvature.

Figures 10A, 10B, 10C, 10D:
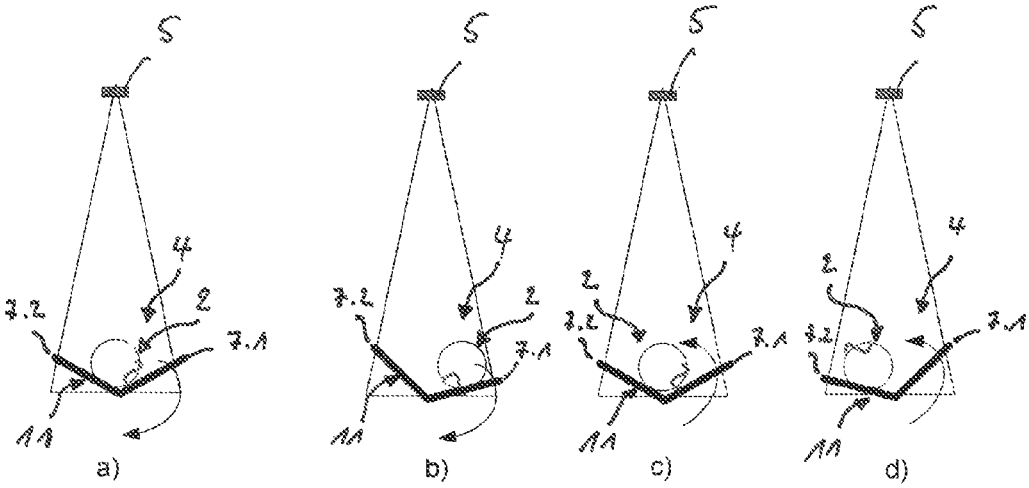
FIGS. 10*a*-10*d* show a sixth embodiment of the device.

In accordance with a further alternative embodiment of the invention as shown in FIG. 10, support element 4 is angled. This angled configuration provides a stationary position between the support arms of the support element. The scanning field of the sensor spreads out on both sides of the drive shaft and the stationary position, respectively. The empty container is manually placed by a customer through a recess in a housing of the device 1 (not shown) at any place on the support element. Because of the force of weight acting on the empty container, the empty container is retained in the stationary position in its input position. If the characteristic distinguishing feature is not recognized by the optical sensor, the support element is rotated first in a clockwise direction as can be seen in FIG. 10*a* and FIG. 10*b*. The empty container rolls down one support arm of the support element. If the radial length l of the support arm or the width of the scanning field of the sensor positioned on the right next to the drive shaft is not sufficient to detect the features, the support element is rotated back counter-clockwise past the input position (FIG. 10*c* and FIG. 10*d*) until the characteristic feature has been detected.

All features of the invention can be essential to the invention both individually and in any combination with each other.

| List of reference numerals | |
|---|---|
| 1 | Device |
| 2 | Empty container |
| 3 | Drive shaft |
| 4 | Support element |
| 5 | Optical sensor |
| 6 | Measurement beam |
| 7.1, 7.2, 7.3 | Support arms |
| 8.1, 8.2, 8.3 | Open ends |
| 9 | Circular path |
| 10 | V-shaped trough |
| 11 | Contact surface |
| 12 | Lateral surface |
| 13.1, 13.2 | 1st/2nd retaining elements |
| 14 | Longitudinal axis |
| 15 | Optical sensor |
| 16.1, 16.2 | Partial measurement beam |
| 17 | Rectangular empty container |
| 18.1, 18.2, 18.3, 18.4 | Lateral face |
| 19 | Reflector unit |
| 20 | First reflector |
| 20.1, 20.2 | Reflector segments |
| 21.1, 21.2 | Second reflector |
| 22.1, 22.2 | Partial measurement beam |
| 23 | First collection bin |
| 24 | Second collection bin |
| 25 | Third collection bin |
| 26 | Fourth collection bin |
| 27 | Conveyor element |
| 28 | Optical sensor |
| a | Distance |
| b | Width |
| l | Radial length |
| r | Radius |
| t | Height |
| w | Scanning field width |
| M | Center plane |
| $\alpha$, $\beta$ | Acute angle |
| $\delta$ | Acceptance angle |
| $\gamma$ | Support angle |
| $\epsilon$, $\epsilon'$ | Measurement angle |

What is claimed:

1. A device for recognizing characteristic features of an empty container comprising;

a drive shaft rotatable about an essentially horizontal axis;

a support element having a contact surface extending from a first end to a second end; the first end being adjacent an input for receiving a container so that the container initially rests on the surface near the first end of the support element, the second end being connected to the drive shaft;

a sensor for scanning the container, the sensor having a field of view;

a functional module; and the drive shaft being rotated to move the support element from an input position to a transfer position during which the container is rolled along the surface of the support element through the field of view of the sensor for recognizing characteristic features of the container, further rotation of the drive shaft transferring the container to the functional module.

2. The device of claim 1, wherein a longitudinal axis of the container on the support element is located oriented parallel to the drive shaft.

3. The device of claim 1, wherein the drive shaft moves the support element to the input position in which the surface is tilted downwardly so that the weight of the container rolls a side of the container against a stop next to the first end of the support element.

4. The device of claim 1, wherein the contact surface of the support element is configured at least in sections planar and/or curved and/or angled.

5. The device of claim 1, wherein the support element comprises at least two structurally identical support arms disposed offset at an angle around the drive shaft, where the support arms project radially from the drive shaft and where a support angle (y) of less than or equal to 180° is included between adjacent support arms.

6. The device of claim 1, wherein the support element comprises at least three structurally identical support arms located offset to each other at the same support angle around the drive shaft and wherein the support arms have an identical radial length.

7. The device of claim 1, wherein the empty container is supported in the input position by means of a fixed first retaining element at one open end of a first support arm and/or in transfer position by way of a fixed second retaining element at an open end of a second support arm.

8. The device of claim 1, wherein the container, after being scanned and depending on the rotational direction of the support element (4) and the rotational speed of said support element, is taken to a specified functional module.

9. The device of claim 1, wherein the position of the support element is continuously analyzed during the movement for scanning or sorting to optimize the further movement for sorting.

10. The device of claim 1, wherein dimensions of the support arms of the support element are selected such that the container is scanned around its complete circumference as said container rolls on the contact surface of the support element.

11. The device of claim 1, further comprising:

two or more optical sensors for optically scanning a lateral surface of the container from at least two different directions.

12. The device of claim 1 that further comprises:

a reflector unit cooperating with the sensor for scanning the container.

13. The device of claim 1 configured in a reverse vending machine for the automated return of empty containers.

14. A method for ascertaining characteristic features of a container, said method comprising:

inserting a lateral surface of the container onto a support arm that is tilted downwardly at a given angle so that the container rolls toward a first end of the support arm;

rotating an essentially horizontally disposed drive shaft connected at a second end of the support arm to move the support arm upwardly causing the container to roll towards the second end of the support arm through a field of view of an optical sensor for detecting characteristic features of the container; and rotating the drive shaft further to move the support arm to carry the container to a functional module.

15. The method of claim 14, wherein the container has a bar code that is read by the optical sensor.

16. The method of claim 14, wherein three support arms are radially disposed about the drive shaft, and wherein:

rotation of the drive shaft causes the container to roll from a distal end of one support arm towards the drive shaft and then further over an adjacent support arm to a distal end thereof.

17. The method of claim 16, which further comprises a plurality of functional modules disposed adjacent distal ends of the support arms; and wherein:

the speed and direction of rotation of the drive shaft is selected to transport the container, after being scanned, to a given functional module.

* * * * *